US011597622B2

(12) United States Patent
Nakazawa

(10) Patent No.: US 11,597,622 B2
(45) Date of Patent: Mar. 7, 2023

(54) MEDIUM DISCHARGING APPARATUS, MEDIUM PROCESSING APPARATUS, AND RECORDING SYSTEM

(71) Applicant: SEIKO EPSON CORPORATION, Tokyo (JP)

(72) Inventor: Atsushi Nakazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/662,763

(22) Filed: May 23, 2022

(65) Prior Publication Data

US 2022/0274800 A1 Sep. 1, 2022

Related U.S. Application Data

(63) Continuation of application No. 16/583,394, filed on Sep. 26, 2019, now Pat. No. 11,358,821.

(30) Foreign Application Priority Data

Sep. 28, 2018 (JP) ..... JP2018-184245

(51) Int. Cl.
*B65H 31/30* (2006.01)
*B65H 29/14* (2006.01)

(52) U.S. Cl.
CPC ..... *B65H 31/30* (2013.01); *B65H 29/14* (2013.01); *B65H 31/3027* (2013.01); (Continued)

(58) Field of Classification Search
CPC B65H 29/14; B65H 31/3027; B65H 31/3036; B65H 31/3045; B65H 31/3054; B65H 31/3081; B65H 31/309; B65H 2404/68; B65H 2301/51256; B65H 2404/342
See application file for complete search history.

(56) References Cited

U.S. PATENT DOCUMENTS 9,988,231 B2 6/2018 Nakano et al.
11,358,821 B2 * 6/2022 Nakazawa ..... B65H 31/30
(Continued)

FOREIGN PATENT DOCUMENTS

JP 2004-345748 A 12/2004
JP 2007-161469 A 6/2007
JP 2008-273659 A 11/2008

*Primary Examiner* — Jeremy R Severson
(74) *Attorney, Agent, or Firm* — Global IP Counselors, LLP

(57) ABSTRACT

A medium discharging apparatus includes a first tray in which a medium is received and placed, a second tray in which the medium discharged from the first tray is received, a discharging mechanism, a curl suppressing member, a link mechanism, a movement mechanism and a cam mechanism. The discharging mechanism discharges the medium from the first tray toward the second tray. The curl suppressing member suppresses curling of the medium discharged from the first tray to the second tray by the discharging mechanism. The curl suppressing member is provided in the link mechanism. The movement mechanism is configured to move the link mechanism and the curl suppressing member in both the discharge direction and a return direction opposite to the discharge direction. The cam mechanism guides movement of the link mechanism.

12 Claims, 15 Drawing Sheets

(52) U.S. Cl.
CPC ..... *B65H 2301/4213* (2013.01); *B65H 2301/51256* (2013.01); *B65H 2402/30* (2013.01); *B65H 2403/513* (2013.01); *B65H 2404/61* (2013.01); *B65H 2404/68* (2013.01); *B65H 2404/693* (2013.01); *B65H 2405/3311* (2013.01); *B65H 2801/27* (2013.01)

(56) References Cited

U.S. PATENT DOCUMENTS

| | | | |
|---|---|---|---|
| 2008/0265484 | A1 | 10/2008 | Fukasawa et al. |
| 2015/0001784 | A1 | 1/2015 | Sekigawa |

* cited by examiner

MEDIUM DISCHARGING APPARATUS, MEDIUM PROCESSING APPARATUS, AND RECORDING SYSTEM

This application is a continuation application of U.S. patent application Ser. No. 16/583,394, filed on Sep. 26, 2019. The present application claims priority to JP Application Serial Number 2018-184245, filed on Sep. 28, 2018. The entire disclosures of U.S. patent application Ser. No. 16/583,394 and JP Application Serial Number 2018-184245 are hereby incorporated herein by reference.

BACKGROUND

1. Technical Field

The present disclosure relates to a medium discharging apparatus that discharges a medium, a medium processing apparatus that includes the medium discharging apparatus, and a recording system that includes the medium discharging apparatus.

2. Related Art

Some medium processing apparatuses that perform processing such as stapling processing and punching processing on a medium include a medium discharging apparatus that is configured to transport and stack media on a first tray, and discharge a media bundle stacked on the first tray to a second tray.

Further, such a medium processing apparatus may be incorporated in a recording system capable of continuously performing processing from recording on a medium in a recording apparatus represented by an ink jet printer to post-processing such as stapling processing on the medium after recording has been performed.

For example, JP-A-2007-161469 discloses a medium processing apparatus that includes a discharge portion that discharges a media bundle stacked in a first tray to a second tray.

When the media bundle is discharged to the second tray, the discharge-direction rear end of the medium on top of the media bundle may rise up, and good stackability on the second tray may not be maintained.

In order to suppress such a defect, in the medium processing apparatus described in JP-A-2007-161469, a front discharge link 21 and a rear discharge link 25 as discharge portions are configured to perform a pushing operation for pushing out and discharging a media bundle from a rear end fence 6 as the first tray, and a holding-down operation for holding down the media bundle discharged to a discharge tray 5 as the second tray. The front discharge link 21 and the rear discharge link 25 alternately perform the pushing operation and the holding-down operation to help prevent the medium on top of the media bundle discharged to the second tray from rising.

In JP-A-2007-161469, because the front discharge link 21 and the rear discharge link 25 rotate with respect to a pivot shaft provided therebelow, during the pushing operation, the attitude of hook-like portions, which are provided at free ends of the front discharge link 21 and the rear discharge link 25, with respect to the media bundle changes. Because the hook-like portions of the front discharge link 21 and the rear discharge link 25 are in contact with the rear end of the media bundle in the discharge direction, as the attitude of the hook-like portions with respect to the media bundle changes, during the process of discharging the media bundle from the first tray to the second tray, the integrity of the media bundle may not be maintained. In addition, in the case where recording is performed on the media, there is a possibility that the media may be rubbed and images may become fuzzy.

SUMMARY

According to an aspect of the present disclosure, a medium discharging apparatus includes a first tray in which a medium is received and placed, a second tray in which the medium discharged from the first tray is received, a discharging mechanism, a curl suppressing member, a link mechanism, a movement mechanism and a cam mechanism. The discharging mechanism discharges the medium from the first tray toward the second tray. The curl suppressing member suppresses curling of the medium discharged from the first tray to the second tray by the discharging mechanism. The curl suppressing member is provided in the link mechanism. The movement mechanism is configured to move the link mechanism and the curl suppressing member in both the discharge direction and a return direction opposite to the discharge direction. The cam mechanism guides movement of the link mechanism.

DESCRIPTION OF EXEMPLARY EMBODIMENTS

Figure 1:
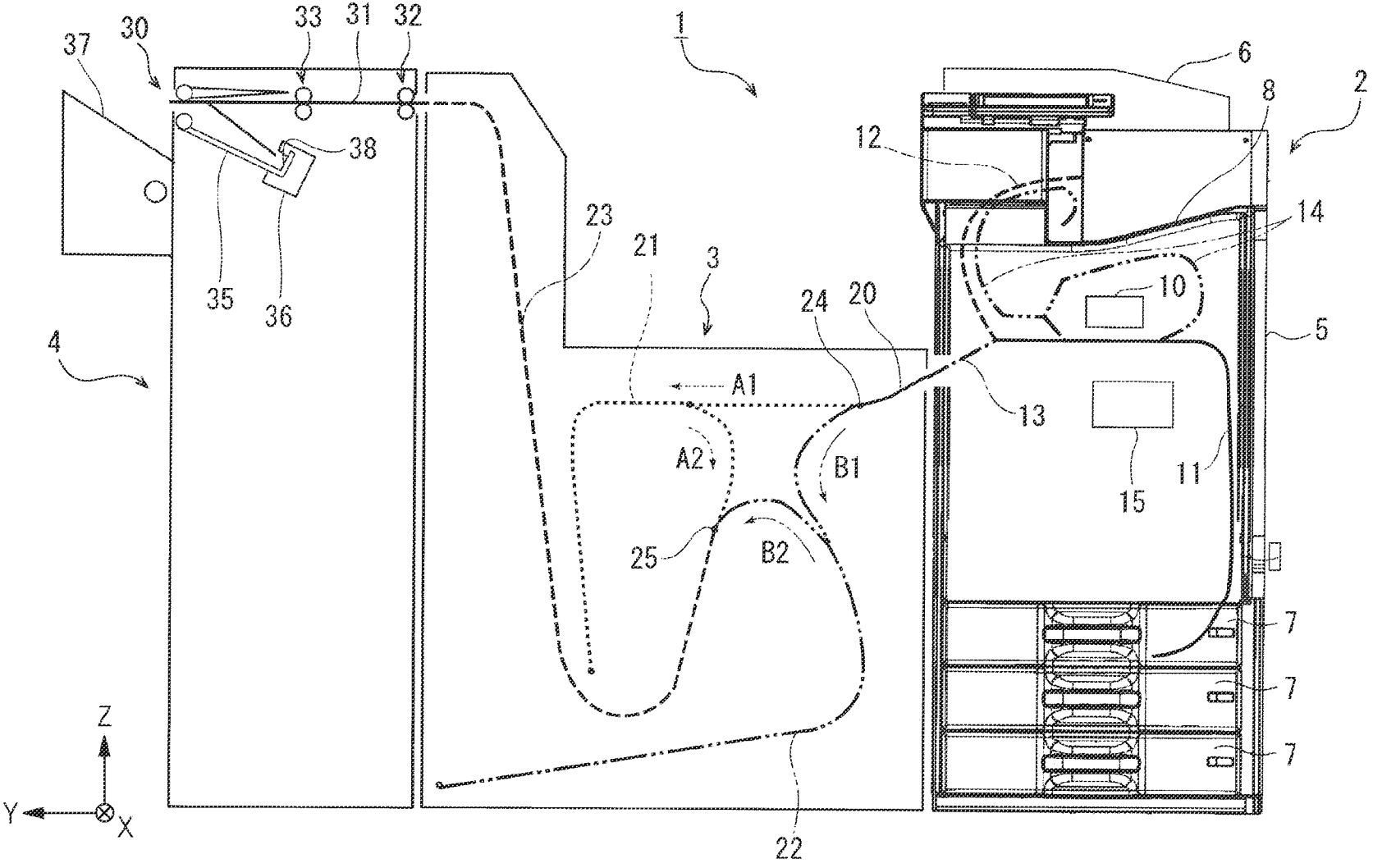
FIG. 1 is a schematic view of a recording system according to a first embodiment.

Hereinafter, the present disclosure will be schematically described.

In a first aspect, a medium discharging apparatus includes a first tray in which a medium is received and placed, a second tray in which the medium discharged from the first tray is received, a discharging mechanism that discharges the medium from the first tray toward the second tray, and a first curl suppressing member that is located above a rear end region of the medium in a discharge direction and that moves so as to follow movement of the rear end region while maintaining attitude until the medium placed on the first tray is discharged from the first tray to the second tray by the discharging mechanism and placed on the second tray.

According to this aspect, until the medium is discharged from the first tray to the second tray by the discharging mechanism, because the first curl suppressing member is positioned above the rear end region in the discharge direction of the medium and moves while maintaining attitude, it is possible to reduce the possibility that the moving first curl suppressing member may affect the attitude or alignment of the medium placed on the first tray while the medium is being discharged from the first tray to the second tray by the discharging mechanism. In addition, the first curl suppressing member can reduce the possibility that the medium may be rubbed against another medium.

Further, "maintaining the attitude" of the first curl suppressing member is meant to include, in addition to the case where the attitude does not change at all, a slight change in attitude that does not affect the attitude or alignment state of the medium.

In a second aspect according to the first aspect, the medium discharging apparatus further includes a second curl suppressing member configured to switch between an advanced state of being advanced above the rear end region of the medium discharged to the second tray and a retracted state of being retracted from above the rear end region, in which the second curl suppressing member is brought into the advanced state in a state where the first curl suppressing member is positioned above the rear end region of the medium discharged to the second tray, and the first curl suppressing member returns to a predetermined position in the first tray after the second curl suppressing member enters the advanced state.

According to this aspect, by setting the second curl suppressing member in the advanced state, it is possible to suppress curling of the rear end region of the medium on the second tray. In addition, since the first curl suppressing member is located above the rear end region of the medium discharged to the second tray until the second curl suppressing member has entered the advanced state, and the first curl suppressing member returns to the predetermined position in the first tray after the second curl suppressing member has entered the advanced state, the first curl suppressing member can help prevent curling of the rear end region of the medium until the second curl suppressing member has entered the advanced state. Thus, curling of the rear end region can be reliably suppressed.

In a third aspect according to the second aspect, the second curl suppressing member is configured to be in contact with the medium and hold down the rear end region.

According to this aspect, because the second curl suppressing member is configured to be in contact with the medium and hold down the rear end region, the rear end of the medium placed on the second tray can be reliably held down.

In a fourth aspect according to the second aspect or the third aspect, the discharging mechanism is formed as a roller pair that nips and feeds the medium, and the discharging mechanism, the first curl suppressing member, and the second curl suppressing member are disposed symmetrically about a center in a width direction intersecting the discharge direction of the medium.

According to this aspect, because the discharging mechanism, the first curl suppressing member, and the second curl suppressing member are disposed symmetrically about the center in the width direction intersecting the discharge direction of the medium, the medium can be discharged stably.

In a fifth aspect according to any one of the first to fourth aspects, the first curl suppressing member is disposed at a position where the first curl suppressing member does not come into contact with a rear end region of a bundle consisting of a maximum number of the media, placed on the first tray in a state where the medium is not curled, and where the first curl suppressing member contacts the rear end region of the medium in a state where the medium is curled.

According to this aspect, it is possible to avoid unintended contact of the first curl suppressing member with the medium in a state where the medium is not curled.

In a sixth aspect according to any one of the first to fifth aspects, the first curl suppressing member includes an opposing surface that faces the medium, and moves while maintaining an attitude in which the opposing surface is parallel to the medium.

According to this aspect, because the first curl suppressing member includes the opposing surface that faces the medium, and the opposing surface moves while maintaining an attitude parallel to the medium, curling of the rear end region of the medium can be appropriately suppressed.

In a seventh aspect according to any one of the first to sixth aspects, the medium discharging apparatus further includes a link mechanism that includes a first arm portion provided along the discharge direction, a second arm portion and a third arm portion that are configured to pivot with respect to the first arm portion while maintaining parallel to each other, and a fourth arm portion disposed parallel to the first arm portion and configured to pivot with respect to the second arm portion and the third arm portion; a movement mechanism configured to move the first arm portion in both the discharge direction and a return direction opposite to the discharge direction; and a cam mechanism that pivots the second arm portion in accordance with the movement of the first arm portion in the discharge direction or the return direction, in which the first curl suppressing member is provided on the fourth arm portion.

According to this aspect, the link mechanism, the moving mechanism, and the cam mechanism can realize a configuration in which the first curl suppressing member maintains a predetermined attitude when moving in the discharge direction.

In an eighth aspect, a medium processing apparatus includes the medium discharging apparatus according to any one of the first to seventh aspects and a processing portion that performs predetermined processing on the medium placed on the first tray.

According to this aspect, in a medium processing apparatus that includes the processing portion that performs the predetermined processing on the medium placed on the first tray of the medium discharging apparatus, the same working effects as in the first to seventh aspects are obtained.

In a ninth aspect, a recording system includes a recording unit including a recorder that performs recording on the medium, and a processing unit that includes the medium discharging apparatus according to any one of the first to seventh aspects, the medium discharging apparatus being configured to discharge the medium after the recording in the recording unit, and that includes a processing portion that performs predetermined processing on the medium placed on the first tray.

According to this aspect, in the recording system including the recording unit including the recorder that performs recording on the medium, and the processing unit that includes the medium discharging apparatus configured to discharge the medium after the recording in the recording unit, and that includes the processing portion that performs predetermined processing on the medium placed on the first tray, the same effects as in the first to seventh aspects can be obtained.

First Embodiment

Hereinafter, a first embodiment will be described with reference to the drawings. In the XYZ coordinate system illustrated in each drawing, the X-axis direction is the width direction of the medium and indicates the apparatus depth direction, the Y-axis direction indicates the apparatus width direction, and the Z-axis direction indicates the apparatus height direction.

Overview of Recording System

A recording system 1 illustrated in FIG. 1 includes, for example, a recording unit 2, an intermediate unit 3, and a processing unit 4 in order from right to left in FIG. 1.

The recording unit 2 includes a line head 10 as a "recorder" that performs recording on a medium. The intermediate unit 3 receives the medium from the recording unit 2 after recording has been performed and delivers it to the processing unit 4. The processing unit 4 includes a medium discharging apparatus 30 that transports the medium after recording has been performed in the recording unit 2, and a processing portion 36 that performs predetermined processing on the medium placed on a first tray 35 in the medium discharging apparatus 30.

In the recording system 1, the recording unit 2, the intermediate unit 3, and the processing unit 4 are connected to one another so that the medium can be transported from the recording unit 2 to the processing unit 4.

The recording system 1 is configured to enable input of, for example, an operation for recording on the medium in the recording unit 2, the intermediate unit 3 and the processing unit 4 from an operation panel (not illustrated). The operation panel can, for example, be provided in the recording unit 2.

The schematic configurations of the recording unit 2, the intermediate unit 3 and the processing unit 4 will be described below in order.

Recording Unit

The recording unit 2 illustrated in FIG. 1 is configured as a multi-function machine including a printer unit 5 including the line head 10 (recorder) that ejects ink, which is a liquid, onto a medium to perform recording, and a scanner unit 6. In the present embodiment, the printer unit 5 is configured as a so-called ink jet printer that performs recording by ejecting ink, which is a liquid, from the line head 10 to a medium.

At a lower portion of the recording unit 2, a plurality of medium housing cassettes 7 are provided. Media housed in the medium housing cassettes 7 are fed to a recording region of the line head 10 through a feeding path 11 illustrated by a solid line in the recording unit 2 of FIG. 1, and a recording operation is performed. The media, after recording has been performed by the line head 10, are sent to either of a first discharge path 12 for discharging the media to a post-recording discharge tray 8 provided above the line head 10 or a second discharge path 13 for sending the media to the intermediate unit 3. In the recording unit 2 of FIG. 1, the first discharge path 12 is indicated by a broken line, and the second discharge path 13 is indicated by an alternate long and short dash line.

In addition, the recording unit 2 includes an inverting path 14 indicated by a two-dot chain line in the recording unit 2 of FIG. 1, and after recording has been performed on a first side of the medium, the medium is inverted to enable recording to be performed on a second side.

In each of the feeding path 11, the first discharge path 12, the second discharge path 13, and the inverting path 14, one or more transport roller pairs (not illustrated) are disposed as an example of a unit for transporting the medium.

The recording unit 2 is provided with a control unit 15 that controls operations related to the transport and recording of the medium in the recording unit 2.

Intermediate Unit

The intermediate unit 3 illustrated in FIG. 1 is disposed between the recording unit 2 and the processing unit 4, and is configured to receive a medium in a receiving path 20 after recording has been performed, the medium having been transferred from the second discharge path 13 of the recording unit 2, and to transport the medium to the processing unit 4. The receiving path 20 is indicated by a solid line in the intermediate unit 3 illustrated in FIG. 1.

In the intermediate unit 3, there are two transport paths along which the medium is transported. The first transport path is a path through which the medium is transported from the receiving path 20 to a discharge path 23 via a first switchback path 21. The second path is a path through which the medium is transported from the receiving path 20 to the discharge path 23 via a second switchback path 22.

The first switchback path 21 is a path that switches back the medium in the arrow A2 direction after receiving the medium in the arrow A1 direction. The second switchback path 22 is a path for switching back the medium in the arrow B2 direction after receiving the medium in the arrow B1 direction.

The receiving path 20 branches into the first switchback path 21 and the second switchback path 22 at a branching portion 24. In addition, the first switchback path 21 and the second switchback path 22 merge at a merging portion 25. Therefore, regardless of which switchback path the medium is sent to from the receiving path 20, the medium can be transferred from the discharge path 23, which is a common path, to the processing unit 4.

One or more transport roller pairs (not illustrated) are disposed in each of the receiving path 20, the first switchback path 21, the second switchback path 22, and the discharge path 23.

In the case where recording is continuously performed on a plurality of media in the recording unit 2, the media having entered the intermediate unit 3 are alternately sent to the transport path passing through the first switchback path 21 and the transport path passing through the second switchback path 22. By this, it is possible to increase the media transport throughput in the intermediate unit 3.

Further, in the recording system 1, the intermediate unit 3 can be omitted. That is, the recording unit 2 and the processing unit 4 can be connected to each other, and the medium after recording in the recording unit 2 can be directly sent to the processing unit 4 without passing through the intermediate unit 3.

As in the present embodiment, when the medium, after recording has been performed in the recording unit 2, is sent to the processing unit 4 via the intermediate unit 3, because the transport time is longer than when the medium is directly sent from the recording unit 2 to the processing unit 4, it is possible to make the ink of the medium drier before being transported to the processing unit 4.

Processing Unit

The processing unit 4 illustrated in FIG. 1 includes the processing portion 36 that performs processing on a medium, and includes the medium discharging apparatus 30 that discharges the medium that has been processed by the processing portion 36. Examples of processing performed by the processing portion 36 include stapling processing and punching processing.

The medium is transferred from the discharge path 23 of the intermediate unit 3 to a transport path 31 of the processing unit 4. A transport roller pair 32 for transporting the medium is provided upstream of the transport path 31 in the transport direction (+Y direction). In addition, downstream of the transport path 31 in the transport direction, a discharge roller pair 33 is provided that discharges the medium to the first tray 35, which is described later.

The medium transferred from the intermediate unit 3 is transported by the transport roller pair 32 in the +Y direction, and is discharged to the first tray 35 by the discharge roller pair 33. The medium placed on the first tray 35 is discharged to a second tray 37 by the medium discharging apparatus 30. After the medium is processed by the processing portion 36, besides discharging the medium from the first tray 35 to the second tray 37, a plurality of media can be stacked on the first tray 35, and the end portions of the media in the discharge direction or the end portions of the media in the width direction can be aligned and the media can be discharged to the second tray 37 as is.

Discharge of Medium from Discharge Roller Pair to First Tray

In the following, the discharge of a medium from the discharge roller pair 33 to the first tray 35 will be described in detail.

Figure 2:
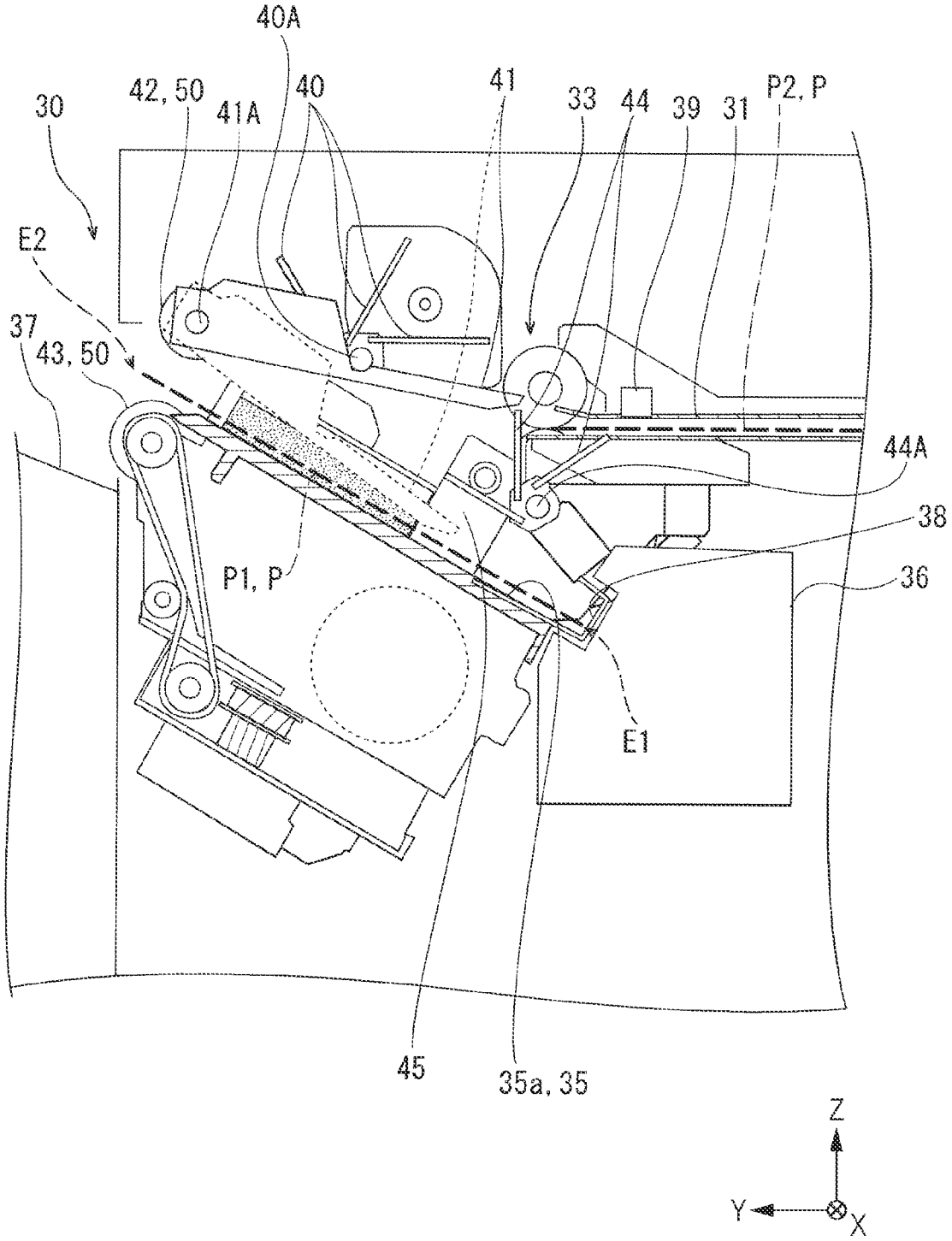
FIG. 2 is a side sectional view illustrating a medium discharging apparatus according to the first embodiment.

As illustrated in FIG. 2, the first tray 35 has an upstream end aligning member 38 for aligning the rear end E1 of a medium P upstream in the discharge direction (+Y direction) of the discharge roller pair 33. Paddles 40 that rotate in contact with the medium P discharged to the first tray 35 and move the medium P toward the upstream end aligning member 38 are provided above the first tray 35.

The discharge roller pair 33 discharges the medium P in the discharge direction substantially in the +Y direction.

In addition, similarly to the paddles 40, guide members 41 are provided above the first tray 35 so as to be in contact, from the upper side, with the medium P discharged by the discharge roller pair 33 and guide the medium P to the first tray 35. The guide members 41 are configured to be displaceable between a retracted position that does not prevent discharge of the medium P by the discharge roller pair 33 as illustrated by the solid line in FIG. 2, and an advanced position where the guide members 41 are advanced in a direction closer to the first tray 35 than the retracted position as illustrated by the dotted line in FIG. 2.

The guide members 41 are located at the retracted position when the medium P is transported in the discharge direction by the discharge roller pair 33 and are displaced from the retracted position to the advanced position when the medium P discharged from the discharge roller pair 33 is guided to the first tray 35.

Figure 3:
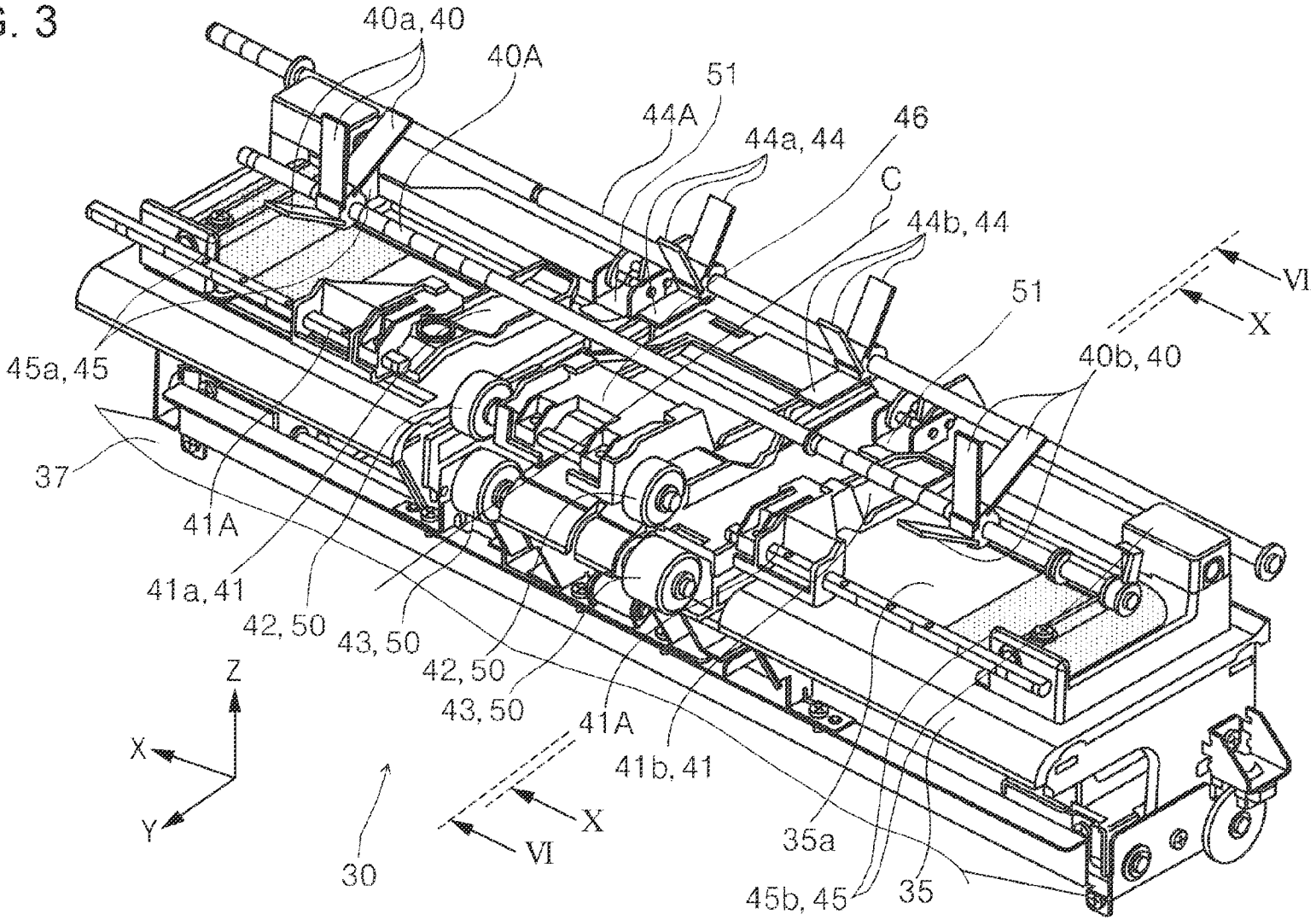
FIG. 3 is a perspective view illustrating the medium discharging apparatus according to the first embodiment.

The paddles 40 and the guide members 41 overlap in the discharge direction of the medium P as illustrated in FIG. 2 and are offset in the X-axis direction, which is the width direction intersecting the discharge direction, as illustrated in FIG. 3. In FIG. 3, the paddles 40 and the guide members 41 are disposed symmetrically with respect to a center C, one on each side of the center C in the width direction. A paddle 40*a* and a guide member 41*a* are provided on the +X side with respect to the center C, and a paddle 40*b* and a guide member 41*b* are provided on the −X side with respect to the center C.

The paddles 40 are plate-like bodies, and a plurality of the plate-like bodies are attached at intervals along the outer periphery of a rotation shaft 40A. The guide members 41 are attached to a swing shaft 41A at the +Y side downstream of the discharge direction, and are configured to swing with the −Y side as the free end.

Upper rollers 42 provided above are provided downstream of the paddle 40 and the guide member 41 in the discharge direction of the medium P. Lower rollers 43 are provided on the first tray 35 located below the upper rollers 42. The upper rollers 42 and the lower rollers 43 are a discharging mechanism 50 that discharges the medium P from the first tray 35 to the second tray 37 described later.

In FIGS. 2 and 3, in the +Y direction of the first tray 35, the second tray 37 for receiving the medium P discharged from the first tray 35 is provided. The medium discharging apparatus 30 that discharges the medium P from the first tray 35 to the second tray 37 will be described in detail later.

The medium P discharged by the discharge roller pair 33 is placed on the first tray 35. The discharge-direction upstream end portion of the medium P discharged to the first tray 35, that is, the rear end E1 of the medium P comes into contact with the upstream end aligning member 38 and aligns therewith. In the case where a plurality of media P are placed on the first tray 35, the upstream end aligning member 38 aligns the rear ends E1 of the plurality of media P.

In addition, the first tray 35 is provided with width-direction aligning members 45 that align the end portions in the width direction of the medium P. The width-direction aligning members 45 are formed of, as illustrated in FIG. 3, a first aligning portion 45*a* provided in the +X direction as a first direction in the width direction with respect to the first tray 35, and a second aligning portion 45*b* provided in the −X direction as a second direction opposite to the first direction with respect to the first tray 35. In the width-direction aligning members 45, after the medium P has been placed between the first aligning portion 45*a* and the second aligning portion 45*b*, the end portions of the medium P in the width direction are aligned by the first aligning portion 45*a* and the second aligning portion 45*b* coming toward each other and coming into contact with end portions of the medium P in the width direction.

Subsequently, with reference to FIGS. 4 and 5, the placement of the medium P discharged by the discharge roller pair 33 on the first tray 35 will be described.

Figure 4:
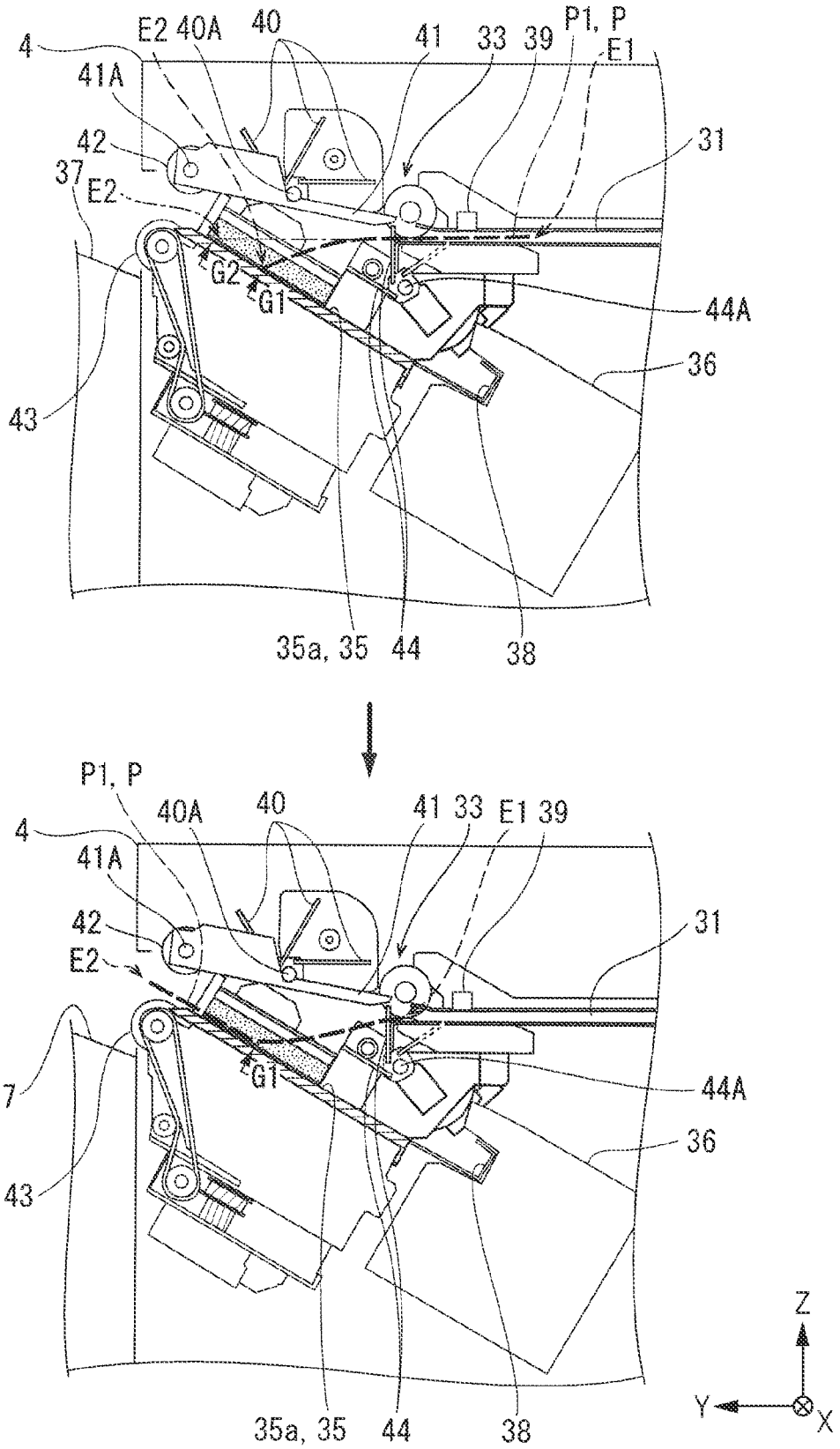
FIG. 4 is a diagram for explaining a flow until a medium discharged from a discharge roller pair is placed on a first tray.

A front end E2 of the medium P discharged from the discharge roller pair 33 lands on a placement surface 35*a* of the first tray 35 as illustrated in the upper diagram of FIG. 4. The landing position of the medium P differs depending on the rigidity and size of the medium P. In the upper view of FIG. 4, the position G2 indicates a position in the case where the front end E2 of the medium P lands on the placement surface 35*a* without drooping. When the rigidity of the medium P is high, the medium P goes straight in the discharge direction and lands on the position G2 of the placement surface 35*a*. On the other hand, for example, in the case of plain paper or thin paper having a lower rigidity than plain paper, the front end E2 thereof hangs down and lands at a position upstream of the position G2 in the discharge direction, for example, a position indicated by reference symbol G1 in the upper drawing of FIG. 4.

After the front end E2 of the medium P lands on the placement surface 35*a*, the medium P travels in the discharge direction on the placement surface 35*a* until the rear end E1 is released from the nip of the discharge roller pair 33 as illustrated in the lower diagram of FIG. 4.

While the medium P is being discharged by the discharge roller pair 33, the guide members 41 are located at the retracted position as illustrated in the upper diagram of FIG. 4 and the lower diagram of FIG. 4, and the guide members 41 do not prevent the discharge of the medium P by the discharge roller pair 33.

Figure 5:
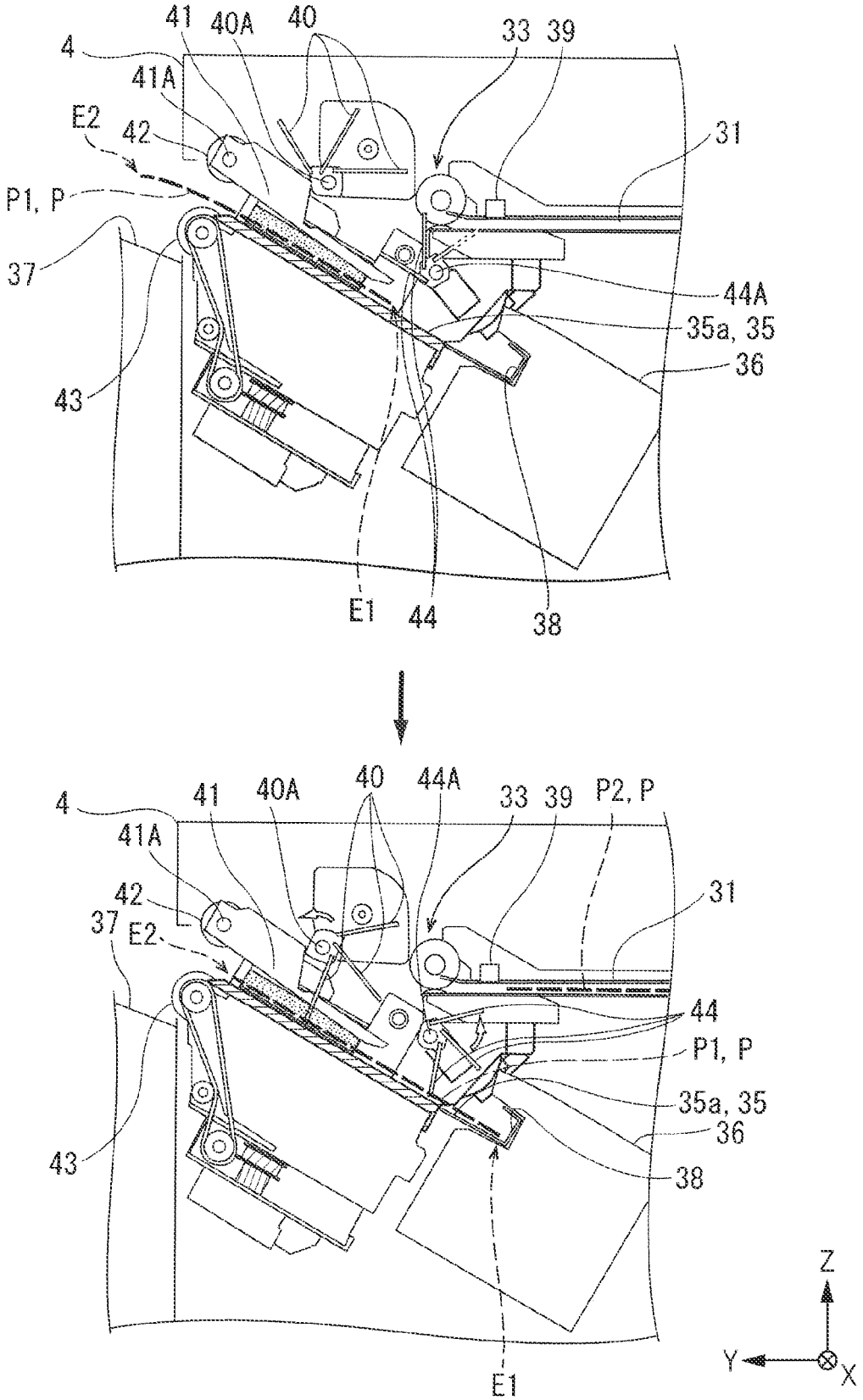
FIG. 5 is a diagram for explaining the flow until the medium discharged from the discharge roller pair is placed on the first tray.

When the rear end E1 of the medium P comes out of the nip of the discharge roller pair 33, the guide members 41 advance to an advanced position closer to the first tray 35 than the retracted position, as illustrated in the upper diagram of FIG. 5. The medium P falls on the placement surface 35*a* by its own weight, and is reliably placed on the placement surface 35*a* by the guide members 41 displaced from the retracted position to the advanced position. Thus, the medium P discharged from the discharge roller pair 33 can be appropriately guided to the first tray 35.

When the medium P is placed on the placement surface 35*a*, the paddles 40 rotate counterclockwise in the planar view of FIG. 5. The rotational direction of the paddles 40 is indicated by a white arrow in the lower diagram of FIG. 5. As the paddles 40 rotate while contacting the medium P, the medium P moves in a direction in which the rear end E1 is directed to the upstream end aligning member 38, and the rear end E1 is abutted against the upstream end aligning member 38. Consequently, the position of the rear end E1 of the medium P placed on the first tray 35 is aligned with the upstream end aligning member 38.

The paddles 40, in a state where the rotation shaft 40A is stopped, are in a position that does not prevent the discharge of the medium P by the discharge roller pair 33 as illustrated, for example, in the upper view of FIG. 4, and the paddles 40 rotate in contact with the medium P on the placement surface 35*a* as the rotation shaft 40A rotates as illustrated in the lower diagram of FIG. 5. In the present embodiment, the paddles 40 make one rotation with respect to one medium P, return to the position illustrated in the upper diagram in FIG. 4, and stop.

In the present embodiment, auxiliary paddles 44 that rotate with respect to a rotation shaft 44A are provided below the discharge roller pair 33. The auxiliary paddles 44 are disposed closer to the upstream end aligning member 38 than are the paddles 40 and, like the paddles 40, rotate counterclockwise in planar view in the lower diagram of FIG. 5. By providing the auxiliary paddles 44, the medium P can be more reliably abutted against the upstream end aligning member 38 for alignment.

Furthermore, after the paddles 40 have been rotated to align the rear end E1 of the medium P with the upstream end aligning member 38, the width-direction end portions of the medium P are aligned by the width-direction aligning members 45 (the first aligning portion 45*a* and the second aligning portion 45*b*).

The first aligning portion 45*a* and the second aligning portion 45*b* are located outside in the width direction with respect to the medium P placed on the first tray 35, and after aligning the rear end E1 of the medium P, the first aligning portion 45*a* and the second aligning portion 45*b* move in directions approaching each other, and an alignment operation is performed to align the width-direction end portions of the medium P. The alignment operation can be performed each time one medium P is discharged to the first tray 35. After the alignment operation is performed, the first aligning portion 45*a* and the second aligning portion 45*b* return to their original positions located outside in the width direction with respect to the medium P to prepare for the next medium discharge.

When a plurality of media P are placed on the first tray 35 continuously, with respect to a first medium P1 discharged first, after alignment of the rear end E1 thereof using the paddles 40 and alignment of both width-direction end portions thereof using the width-direction aligning members 45 have been performed, the guide members 41 are returned to the retracted position before a second medium P2 is discharged from the discharge roller pair 33. Preferably, the guide members 41 are in the advanced position until immediately before the second medium P2 is discharged from the discharge roller pair 33. As a result, since the guide members 41 hold down the first medium P1 first placed on the first tray 35, curling of the first medium P1 can be suppressed.

The timing for displacing the guide members 41 between the retracted position and the advanced position, the timing for rotating the paddles 40, and the timing for performing the alignment operation of the width-direction aligning members 45 can be determined on the basis of the detection of the medium P by a medium detection unit 39 provided upstream of the discharge roller pair 33. For example, each operation can be performed after a predetermined time has elapsed since detection of the rear end E1 of the medium P by the medium detection unit 39.

Processing such as stapling processing is performed by the processing portion 36 illustrated in FIG. 2 on one or more sheets of media P placed on the first tray 35 with the rear end E1 and both width-direction end portions being aligned. The medium P after being processed by the processing portion 36 is discharged from the first tray 35 to the second tray 37 by the upper rollers 42 and the lower rollers 43 as the "discharging mechanism 50" described above.

Further, the plurality of media P in a state in which the end portions are aligned in the first tray 35 can be discharged from the first tray 35 to the second tray 37 as a media bundle without performing processing by the processing portion 36.

Medium Discharging Apparatus

Subsequently, the medium discharging apparatus 30 that performs discharge of the medium P from the first tray 35 to the second tray 37 will be described.

Figure 6:
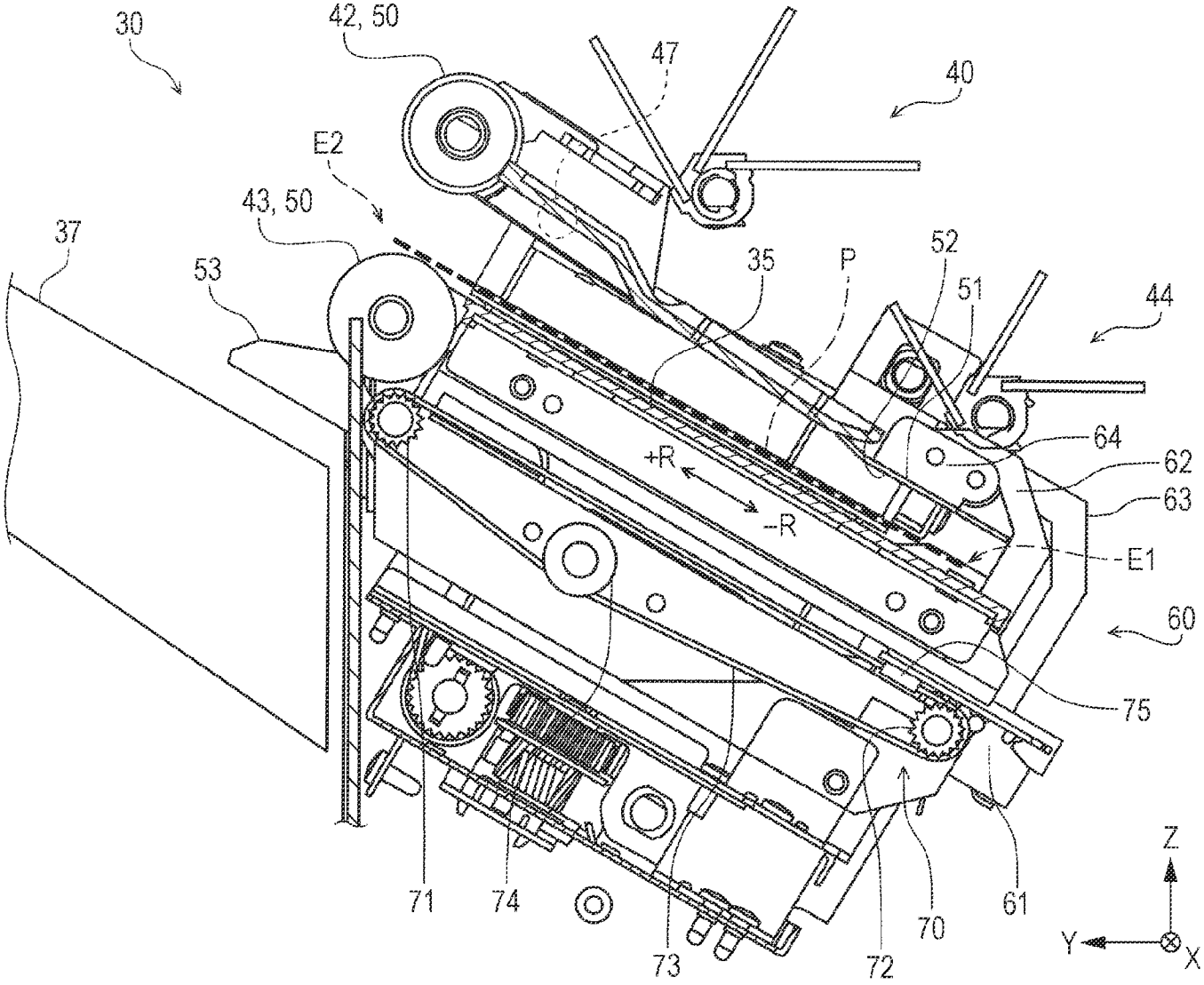
FIG. 6 is a view along arrows VI-VI in FIG. 3.

As illustrated in FIG. 6, the medium discharging apparatus 30 includes: the discharging mechanism 50 formed of the first tray 35, the second tray 37, the upper rollers 42, and the lower rollers 43; and a first curl suppressing member 51.

The upper rollers 42 and the lower rollers 43 as the discharging mechanism 50 are "roller pairs" that nip and feed the medium P. The upper rollers 42 and the lower rollers 43 are each rotationally driven by a drive source (not illustrated). The upper rollers 42 are rotationally driven clockwise in the planar view of FIG. 6, and the lower rollers 43 are rotationally driven counterclockwise in the planar view of FIG. 6.

As illustrated in FIG. 3, the lower rollers 43 are attached to the first tray 35 so as to be rotatable. Also, in FIG. 3, the upper rollers 42 are attached to a roller holder 46 so as to be rotatable. The upper rollers 42 and the lower rollers 43 are disposed symmetrically with respect to the center C in the X-axis direction, which is the width direction.

Figure 11:
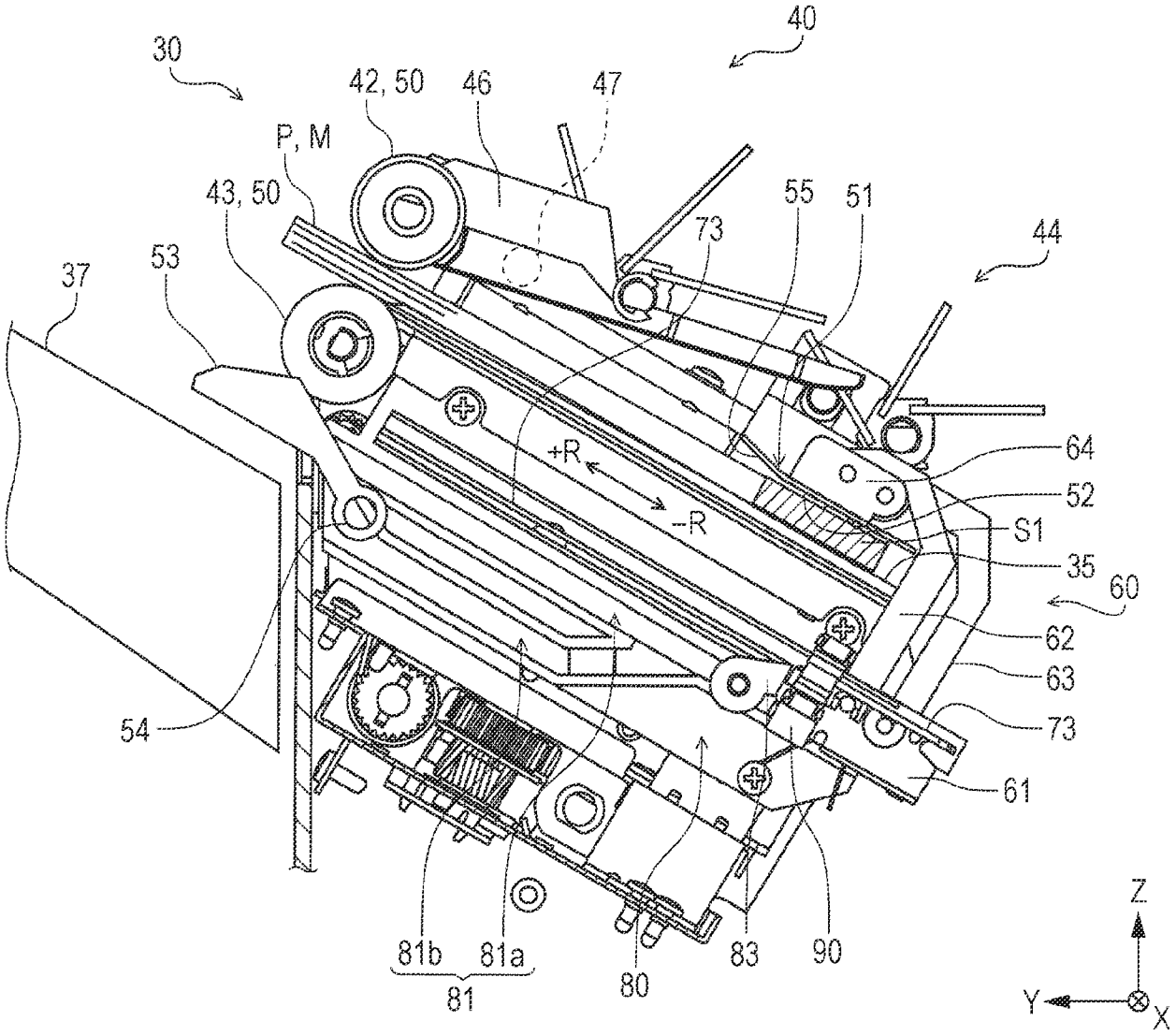
FIG. 11 is a side sectional view illustrating a state in which the first curl suppressing member is positioned above a rear end of a medium placed on the first tray.

The roller holder 46 that supports the upper rollers 42 is configured to rock with respect to a rocking shaft 47 illustrated in FIG. 6 (see also FIG. 9) and configured to switch between a separated state in which the upper rollers 42 are separated from the lower rollers 43 as illustrated in FIG. 6 and a proximal state in which the upper rollers 42 are closer to the lower rollers 43 than in the separated state as illustrated in FIG. 11.

The upper rollers 42 are in a separated state while the medium P is being discharged from the discharge roller pair 33 to the first tray 35 as illustrated in FIGS. 4 and 5. Thus, the upper rollers 42 are disposed at a position that does not hinder the discharge of the medium P from the discharge roller pair 33.

In the case where the medium P placed on the first tray 35 is discharged to the second tray 37, the upper rollers 42 are brought into the proximal state illustrated in FIG. 11 and nip the medium P between the upper rollers 42 and the lower rollers 43 and send it toward the second tray 37. In each of FIGS. 11 to 14, reference symbol M indicates a media bundle in which the maximum number of media P that can be placed on the first tray 35 are stacked.

Figure 13:
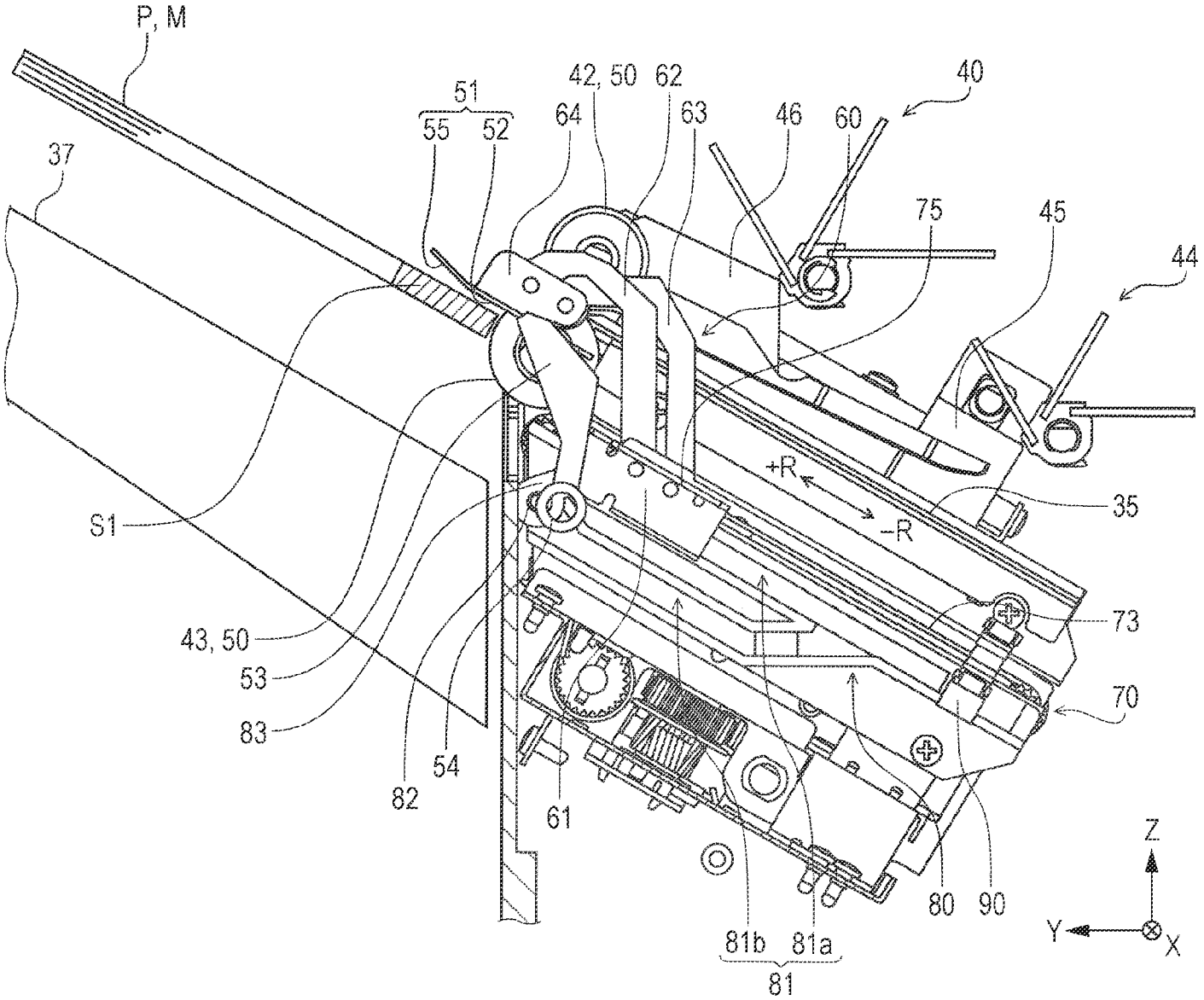
FIG. 13 is a side sectional view illustrating a state in which a medium has come out of the nip of the discharging mechanism.
Figure 14:
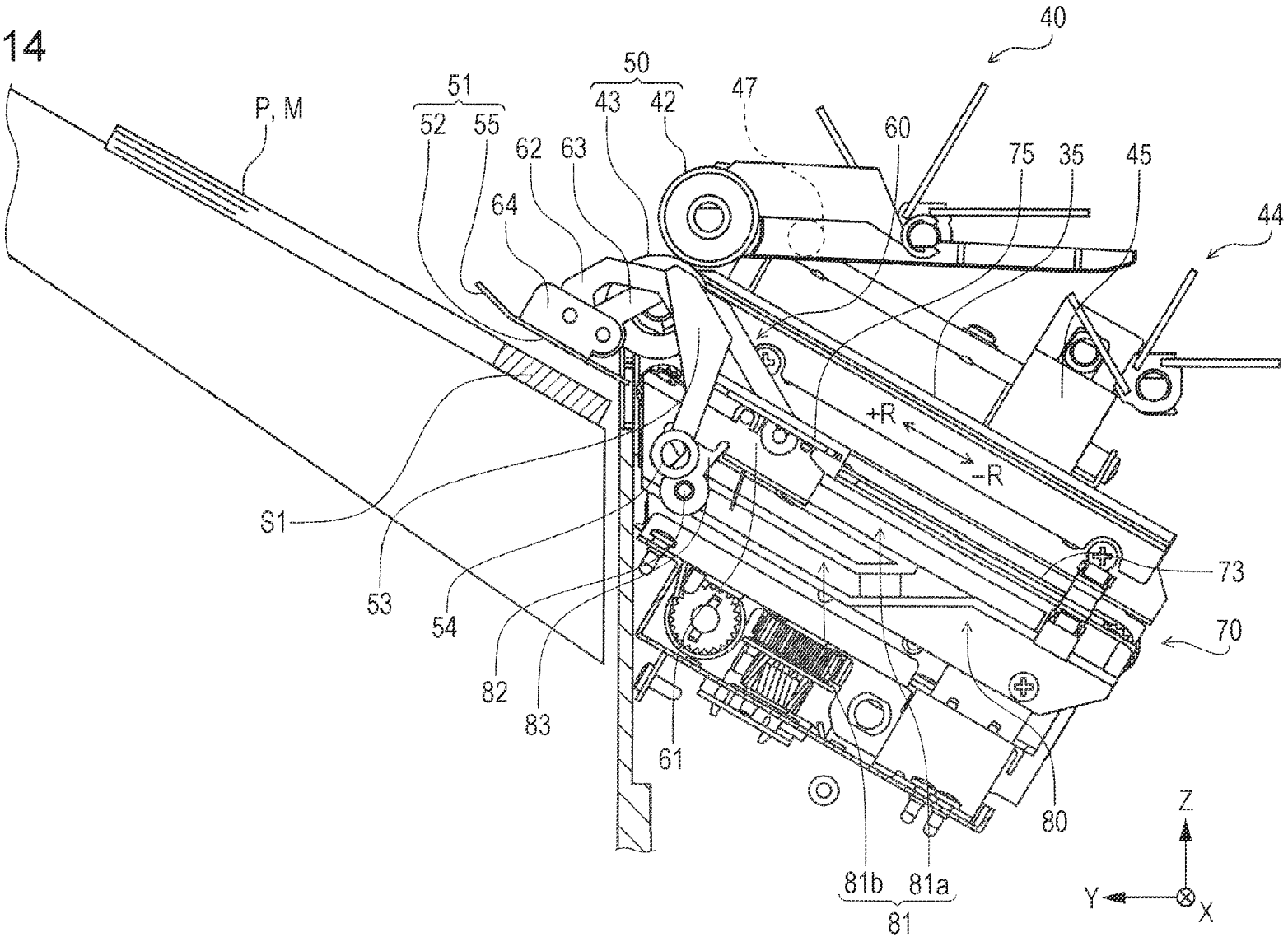
FIG. 14 is a side sectional view illustrating a state in which the first curl suppressing member is located above the rear end of a medium placed on the second tray.
Figure 15:
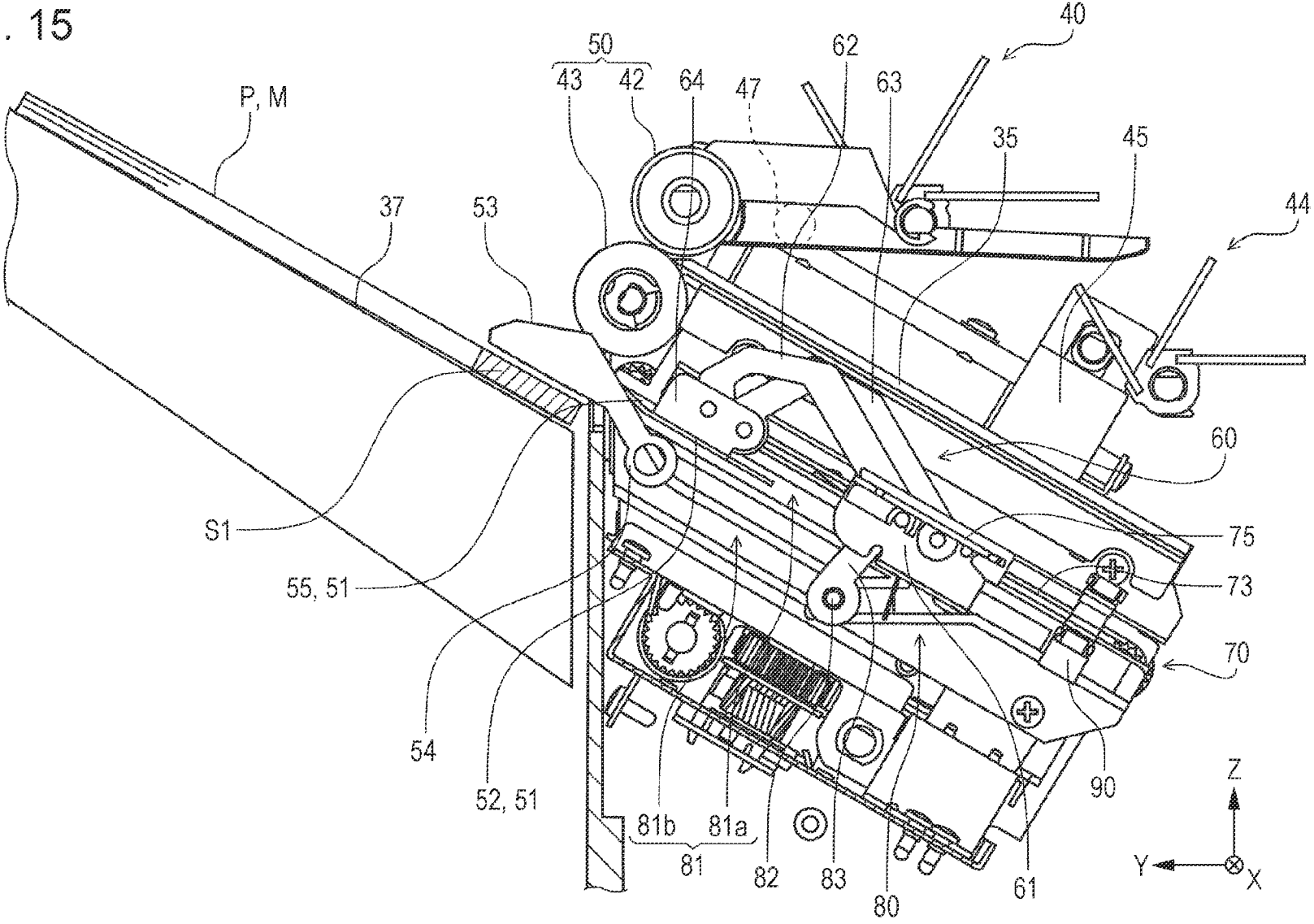
FIG. 15 is a side cross-sectional view illustrating a state in which a second curl suppressing member holds down the rear end of a medium placed on the second tray.

As illustrated in FIG. 13, when the rear end E1 of the media bundle M passes through the nip between the upper rollers 42 and the lower rollers 43, the media bundle M drops under its own weight and is placed on the second tray 37 as illustrated in FIGS. 14 and 15.

Next, the first curl suppressing members 51 will be described. As illustrated in FIG. 3, the first curl suppressing members 51 are disposed symmetrically with respect to the center C in the width direction (X-axis direction). The first curl suppressing members 51 are disposed outside of the discharging mechanism 50 (the upper rollers 42 and the lower rollers 43) in the width direction.

The first curl suppressing members 51 are located above a rear end region S1 including the rear end E1 of the medium P discharged in the first tray 35, as illustrated in FIG. 11.

In the present embodiment, the rear end region S1 is a region of the medium P that faces opposing surfaces 52 of the first curl suppressing members 51. In addition, in the present embodiment, the rear end region S1 includes the rear end E1, but the rear end region S1 may not necessarily include the rear end E1. That is, if the center position of the rear end area S1 in the discharge direction is closer to the rear end than the center position of the medium P in the discharge direction, the rear end region S1 may have any range.

Here, until the medium P is discharged from the first tray 35 to the second tray 37 by the discharging mechanism 50, that is, from FIG. 11 to FIG. 14, the first curl suppressing members 51 are characterized in that they are located above the rear end region S1 of the medium P (medium bundle M) and move while maintaining attitude.

That is, until the medium P is discharged from the first tray 35 to the second tray 37, the first curl suppressing members 51 move so as to follow movement of the medium P without changing their relative position with respect to the rear end region S1 and without changing attitude.

As a result, until the medium P is discharged from the first tray 35 to the second tray 37 by the discharging mechanism 50, as well as the first curl suppressing members 51 suppressing curling of the rear end region S1 of the medium P, it is possible to reduce the likelihood of the first curl suppressing members 51, which move so as to follow the medium P being discharged, coming into contact with the medium P and affecting the attitude or alignment thereof. In addition, the first curl suppressing members 51 can reduce the likelihood of a force being applied that causes the overlapping media P to rub against each other. The configuration for moving the first curl suppressing members 51 in the discharge direction will be described later.

The first curl suppressing members 51 are, as illustrated in FIG. 11, disposed at a position where they do not come into contact with the bundle of the maximum number of media P that can be placed on the first tray 35 in a state where the media P are not curled, that is, the rear end region S1 of the media bundle M, and the first curl suppressing members 51 are disposed at a position where they come into contact with the rear end region S1 of the media P in the case where the media P are curled. That is, as illustrated in FIG. 11, the first curl suppressing members 51 are disposed away from the rear end region S1 of the non-curled media bundle M. In the case where the media P are curled, the rear end region S1 of the media P is disposed so as to be in contact with the first curl suppressing members 51, even if the number of the media P placed on the first tray 35 is one.

As a result, the first curl suppressing members 51 can suppress lifting of the rear end region S1 of media P that are in a curled state, and it is possible to prevent the first curl suppressing members 51 from inadvertently coming into contact with media P that are not in a curled state.

In addition, the first curl suppressing members 51 illustrated in FIGS. 11 to 15 respectively include the opposing surfaces 52 facing the medium P, and move while maintaining an attitude in which the opposing surfaces 52 are parallel to the medium P. As a result, curling of the rear end region S1 of the medium P can be suppressed more adequately.

In the present embodiment, the first tray 35 and the second tray 37 are formed in parallel. Therefore, regardless of whether the media bundle M is on the first tray 35 or the second tray 37, the first curl suppressing members 51 can maintain an attitude in which the opposing surfaces 52 are parallel to the medium P.

In addition, the first curl suppressing members 51 respectively include inclined surfaces 55 connected to the opposing surfaces 52 on the +Y side of the opposing surfaces 52. By providing the inclined surfaces 55 on the first curl suppressing members 51, the medium P can be easily received below the opposing surfaces 52.

Figure 10:
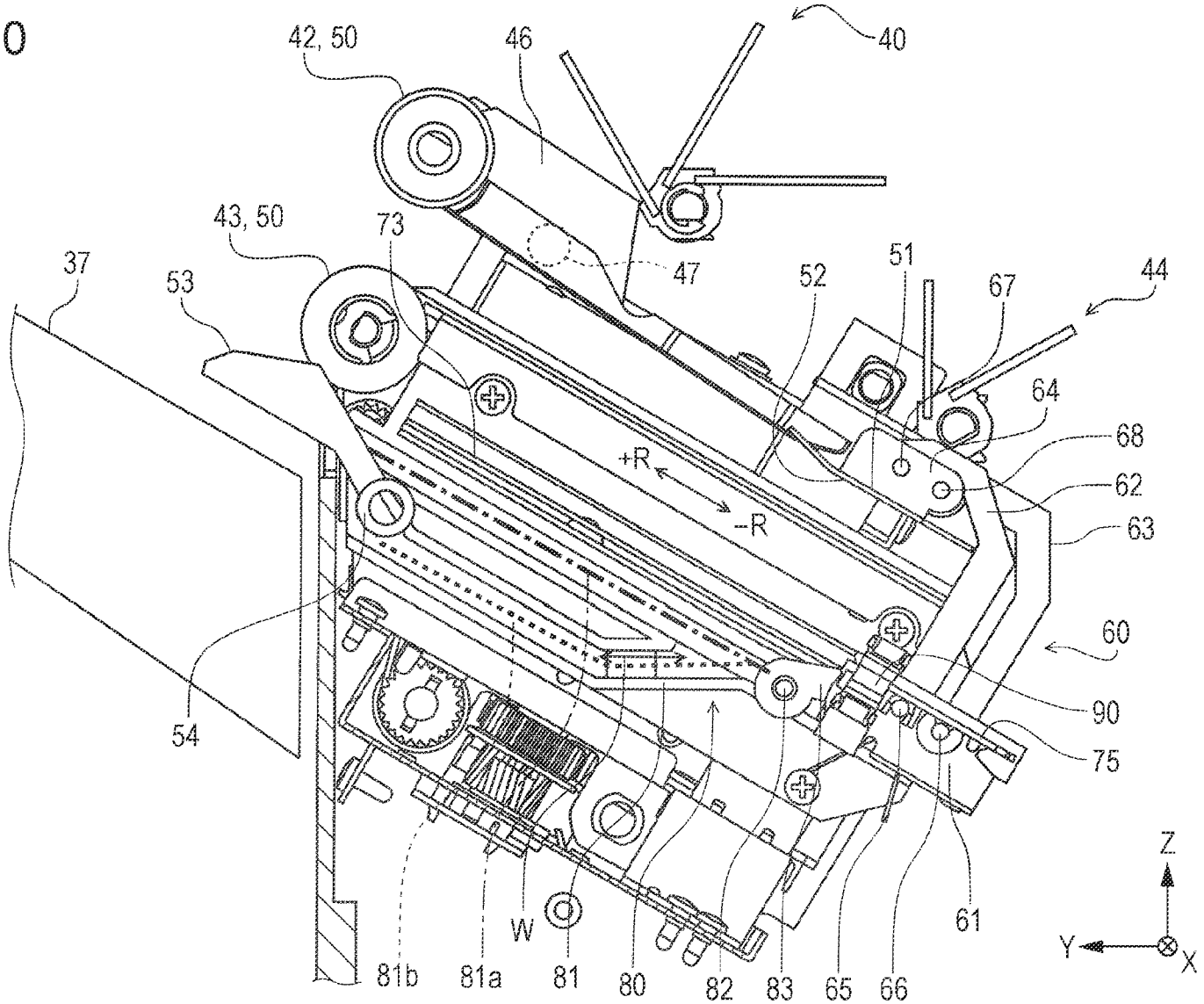
FIG. 10 is a view along arrows X-X in FIG. 3.
Figure 12:
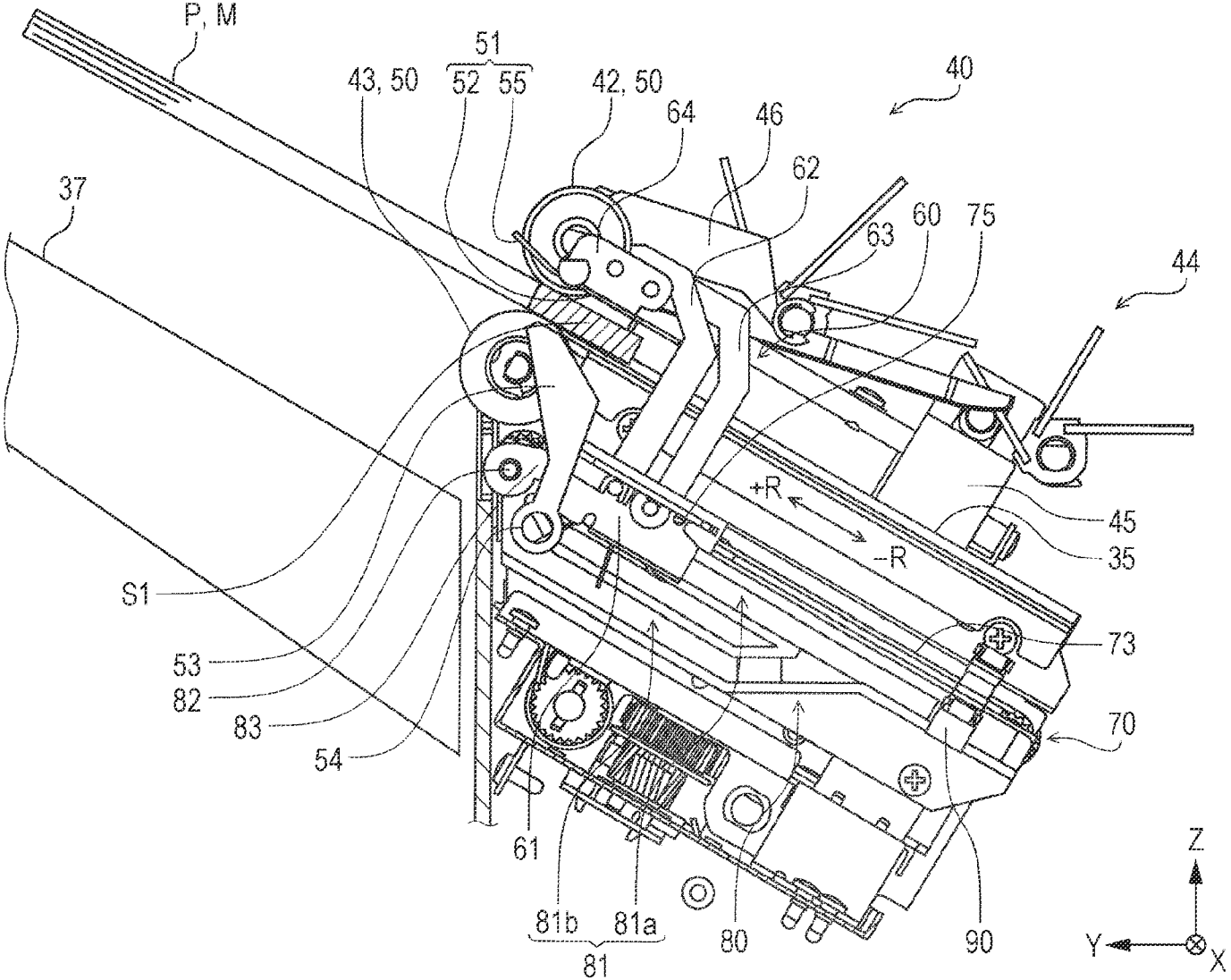
FIG. 12 is a side sectional view illustrating a state in which a medium placed on the first tray is being discharged by the discharging mechanism.

The medium discharging apparatus 30 further includes second curl suppressing members 53 illustrated in FIG. 10. The second curl suppressing members 53 are configured to switch between an advanced state of being advanced above the rear end area S1 of the medium P discharged to the second tray 37 as illustrated in FIG. 15 and a retracted state of being retracted away from above the rear end region S1 as illustrated in FIG. 12. In the present embodiment, the second curl suppressing members 53 pivot about a pivot shaft 54, and are switched between the advanced state (FIG. 15) and the retracted state (FIG. 12).

In the present embodiment, the second curl suppressing members 53 are in an advanced state as illustrated in FIG. 10 before the start of the discharge of the medium P from the first tray 35 by the upper rollers 42 and the lower rollers 43 (the discharging mechanism 50). Then, while the upper rollers 42 and the lower rollers 43 nip and discharge the medium P, the second curl suppressing members 53 are in the retracted state (FIG. 12) from the advanced state (FIG. 11). That is, as illustrated in FIG. 13, until the medium P is released from the nip between the upper rollers 42 and the lower rollers 43, the second curl suppressing members 53 are in the retracted state away from the advanced state.

As illustrated in FIG. 14, when the medium P is discharged to the second tray 37, in a state where the first curl suppressing members 51 is located above the rear end region S1 of the medium P, the second curl suppressing members 53 will be set to the advanced state from the retracted state. When the second curl suppressing members 53 in the advanced state hold down the medium P discharged to the second tray 37, the first curl suppressing members 51 return to their predetermined position (FIG. 6 or FIG. 10) in the first tray 35. In FIG. 10, reference sign 90 denotes a position sensor 90 that detects that the first curl suppressing members 51 are at their predetermined position.

The second curl suppressing members 53 can suppress curling of the rear end region S1 of the medium P on the second tray 37. In addition, since, until the second curl suppressing member 53 have entered the advanced state, the first curl suppressing members 51 are located above the rear end region S1 of the medium P discharged to the second tray 37 (see FIG. 14), and, as illustrated in FIG. 15, the first curl suppressing members 51 return to their predetermined position in the first tray 35 after the second curl suppressing members 53 have entered the advanced state, the first curl suppressing members 51 can help prevent curling of the rear end region S1 of the medium P until the second curl suppressing members 53 have entered the advanced state. Thus, curling of the rear end region S1 can be reliably suppressed.

In the present embodiment, the second curl suppressing members 53 are configured to be in contact with the medium P to hold down the rear end region S1. When a plurality of media P are discharged as the media bundle M onto the second tray 37, the second curl suppressing members 53 contact the rear end region S1 of the topmost medium P of the media bundle M. Therefore, the second curl suppressing members 53 can reliably hold down the rear end region S1 of the medium P placed on the second tray 37.

In addition, in the present embodiment, the second curl suppressing members 53 are disposed symmetrically with respect to the center C (FIG. 3) in the width direction (X-axis direction) similarly to the discharging mechanism 50 (the upper rollers 42 and the lower rollers 43) and the first curl suppressing members 51. The second curl suppressing members 53 can be disposed, for example, on the outer sides of the first curl suppressing members 51 in the width direction.

Since the discharging mechanism 50, the first curl suppressing members 51, and the second curl suppressing members 53 are disposed symmetrically with respect to the center C in the width direction, the medium P can be stably discharged.

First Curl Suppressing Members

In the following, a specific configuration will be described in which the first curl suppressing members 51 are moved above the rear end region S1 of the medium P discharged from the first tray 35 to the second tray 37 by the discharging mechanism 50 and are moved while maintaining attitude.

In the medium discharging apparatus 30 illustrated in FIG. 9, the first curl suppressing members 51 are provided in a link mechanism 60 described later. Furthermore, the medium discharging apparatus 30 includes a cam mechanism 80, a belt drive mechanism 70, and the link mechanism 60.

Figure 7:
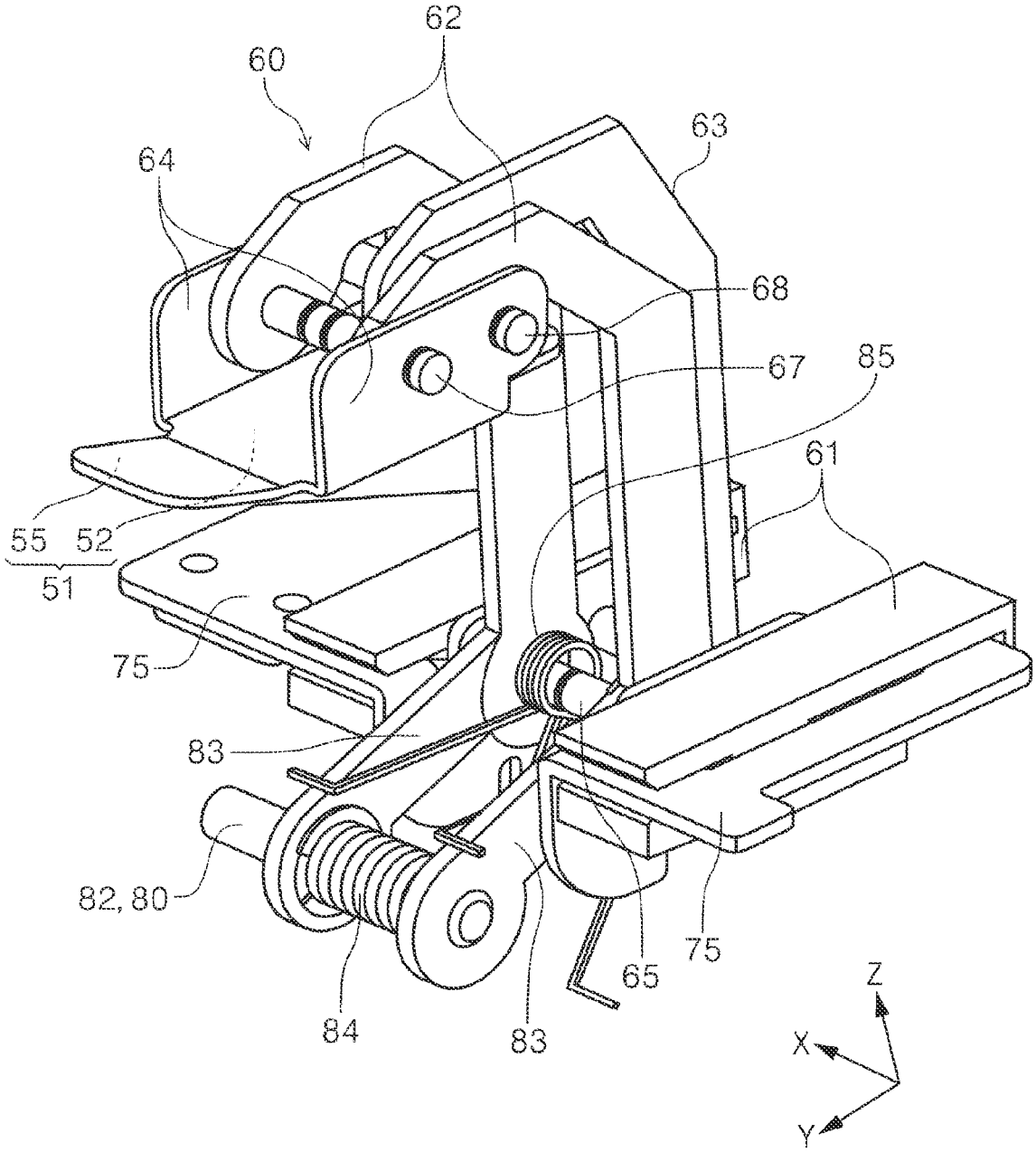
FIG. 7 is a perspective view of a link mechanism.
Figure 8:
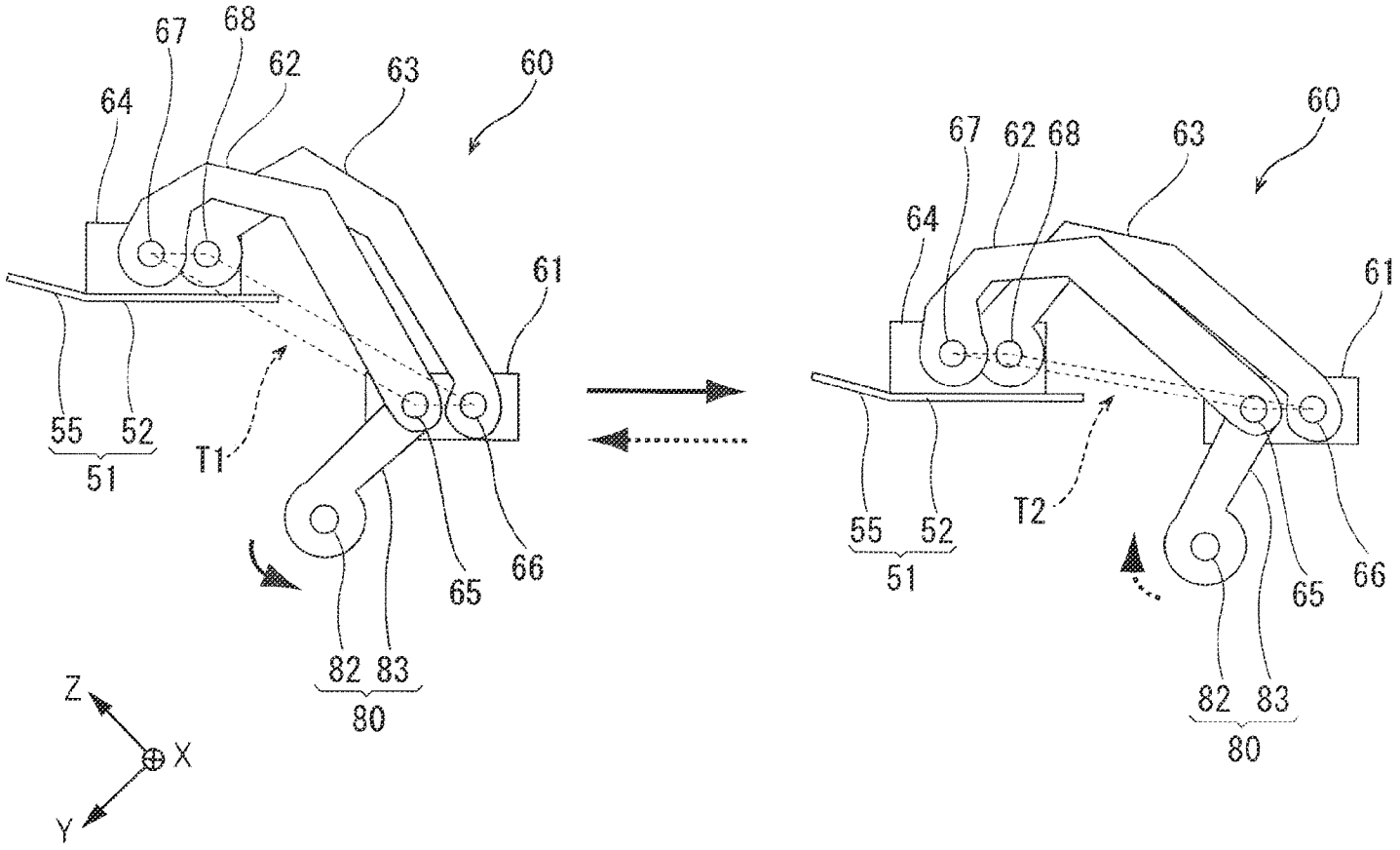
FIG. 8 is a schematic view for explaining the operation of the link mechanism.

The link mechanism 60 is formed as a so-called four-bar link mechanism as illustrated in FIGS. 7 and 8. Referring to FIG. 8, the link mechanism 60 includes a first arm portion 61 provided along the discharge direction, a second arm portion 62 and a third arm portion 63 that can rotate with respect to the first arm portion 61 while maintaining parallel to each other, and a fourth arm portion 64 that is disposed parallel to the first arm portion 61 and that can rotate with respect to the second arm portion 62 and the third arm portion 63.

As illustrated in FIG. 8, the second arm portion 62 is connected to the first arm portion 61 at a first pivoting portion 65 so as to be pivotable, and is connected to the fourth arm portion 64 at a second pivoting portion 67 so as to be pivotable. The third arm portion 63 is connected to the first arm portion 61 at a third pivoting portion 66 so as to be pivotable and is connected to the fourth arm portion 64 at a fourth pivoting portion 68 so as to be pivotable.

As illustrated in FIG. 7, the first arm portion 61 is provided as a pair spaced apart in the width direction (X-axis direction). In addition, the second arm portion 62 is provided as a pair spaced apart and between the first arm portions 61 and 61. One third arm portion 63 is provided between the second arm portions 62 and 62. The fourth arm portion 64 is provided as a pair spaced apart and outside the second arm portions 62 and 62. The first curl suppressing members 51 are integrally formed with the fourth arm portions 64 and 64 so as to be continuous with the lower portions of the fourth arm portions 64 and 64.

In the left view of FIG. 8, a parallelogram T1 is formed by connecting the centers of the first pivoting portion 65, the second pivoting portion 67, the third pivoting portion 66, and the fourth pivoting portion 68.

Each of cam members 83 constituting the cam mechanism 80 is fixed to an end of a corresponding one of the second arm portions 62 on the first pivoting portion 65 side. In the planar view of the left view of FIG. 8, when the cam member 83 is rotated counterclockwise, the second arm portion 62 pivots counterclockwise about the first pivoting portion 65, and the third arm portion 63 pivots so as to be parallel to the second arm portion 62. Then, the fourth arm portion 64 moves in parallel in a direction approaching the first arm portion 61. Since the first curl suppressing member 51 is provided on the fourth arm portion 64, the position in the height direction can be changed while maintaining the attitude of the first curl suppressing member 51. In the right view of FIG. 8, when the centers of the first pivoting portion 65, the second pivoting portion 67, the third pivoting portion 66, and the fourth pivoting portion 68 are connected, a parallelogram T2 that is flatter than the parallelogram T1 is formed.

The link mechanism 60 is provided with a torsion spring 85 illustrated in FIG. 7. The torsion spring 85 presses the link mechanism 60 toward the attitude illustrated in the right diagram of FIG. 8. The link mechanism 60 takes the attitude illustrated in the left view of FIG. 8 against the pressing force of the torsion spring 85. The detailed structure of the cam mechanism 80 for rotating the cam members 83 will be described after the belt drive mechanism 70 is described.

The belt drive mechanism 70 will be described below. The belt drive mechanism 70 illustrated in FIG. 6 is a "movement mechanism" capable of moving the first arm portion 61 in both the discharge direction +R and the return direction −R opposite to the discharge direction.

As illustrated in FIG. 6, the belt drive mechanism 70 includes a drive pulley 71 rotationally driven by a drive source (not illustrated), a driven pulley 72, and an endless belt 73 that is wound around the drive pulley 71 and the driven pulley 72. Inside the ring of the endless belt 73, a tension pulley 74 for applying tension to the endless belt 73 is provided. The link mechanism 60 is attached to the endless belt 73 via a carriage portion 75. Due to the endless belt 73 rotating counterclockwise in the planar view of FIG. 6, the link mechanism 60 including the first curl suppressing member 51 moves in the discharge direction +R, and the endless belt 73 rotates clockwise, whereby the first curl suppressing member 51 (the link mechanism 60) moves in the return direction −R.

Next, the cam mechanism 80 will be described. The cam mechanism 80 rotates the second arm portions 62 in accordance with the movement of the first arm portions 61 in the discharge direction +R or the return direction −R.

More specifically, as illustrated in FIG. 7, the cam mechanism 80 includes the cam members 83 respectively fixed to the second arm portions 62 of the link mechanism 60, a guide pin 82 provided for the cam members 83, and guide grooves 81 provided below the first tray 35 for guiding the guide pin 82. The guide grooves 81 include a first groove portion 81*a* through which the guide pin 82 passes when the link mechanism 60 moves in the discharge direction +R, and a second groove portion 81*b* provided below the first groove portion 81*a* and through which the guide pin 82 passes when the link mechanism 60 moves in the return direction −R. In FIG. 10, the first groove portion 81*a* is indicated by an alternate long and short dash line, and the second groove portion 81*b* is indicated by a dotted line.

FIG. 11 illustrates a state in which the media P (media bundle M) are placed on the first tray 35, and the first curl suppressing member 51 is at a predetermined position in the return direction −R. When the endless belt 73 of the belt drive mechanism 70 is rotated counterclockwise in the planar view of FIG. 11, the link mechanism 60 attached to the endless belt 73 via the carriage portion 75 moves in the discharge direction +R. That is, the first curl suppressing member 51 moves in the discharge direction +R. In addition, the guide pin 82 provided on the cam member 83 is guided by the first groove portion 81*a* and moves in the discharge direction +R.

As illustrated in FIG. 12, when the guide pin 82 reaches the end of the first groove portion 81*a* in the discharge direction +R side, the guide pin 82 is disengaged from the first groove portion 81*a*. Then, by the pressing force of the torsion spring 85 illustrated in FIG. 7, the second arm portion 62 and the cam member 83 fixed thereto rotate counterclockwise as illustrated in FIG. 13 and FIG. 14. Thus, the first curl suppressing members 51 are moved from the top of the first tray 35 to the top of the second tray 37. The first curl suppressing members 51 are located above the rear end region S1 of the medium P placed on the second tray 37.

The first curl suppressing members 51 provided in the link mechanism 60 are moved in the return direction −R, and in the case of returning to their predetermined position in the first tray illustrated in FIG. 10, the endless belt 73 is rotated clockwise in the planar view of FIG. 10.

The guide pin 82 provided on the cam member 83 is guided by the second groove portion 81*b* and moves in the return direction −R. The second groove portion 81*b* merges with the first groove portion 81*a* in the return direction −R, and moves the link mechanism 60 in the return direction −R until the position sensor 90 detects the carriage portion 75. Thus, the first curl suppressing members 51 can be returned to their predetermined position.

Figure 9:
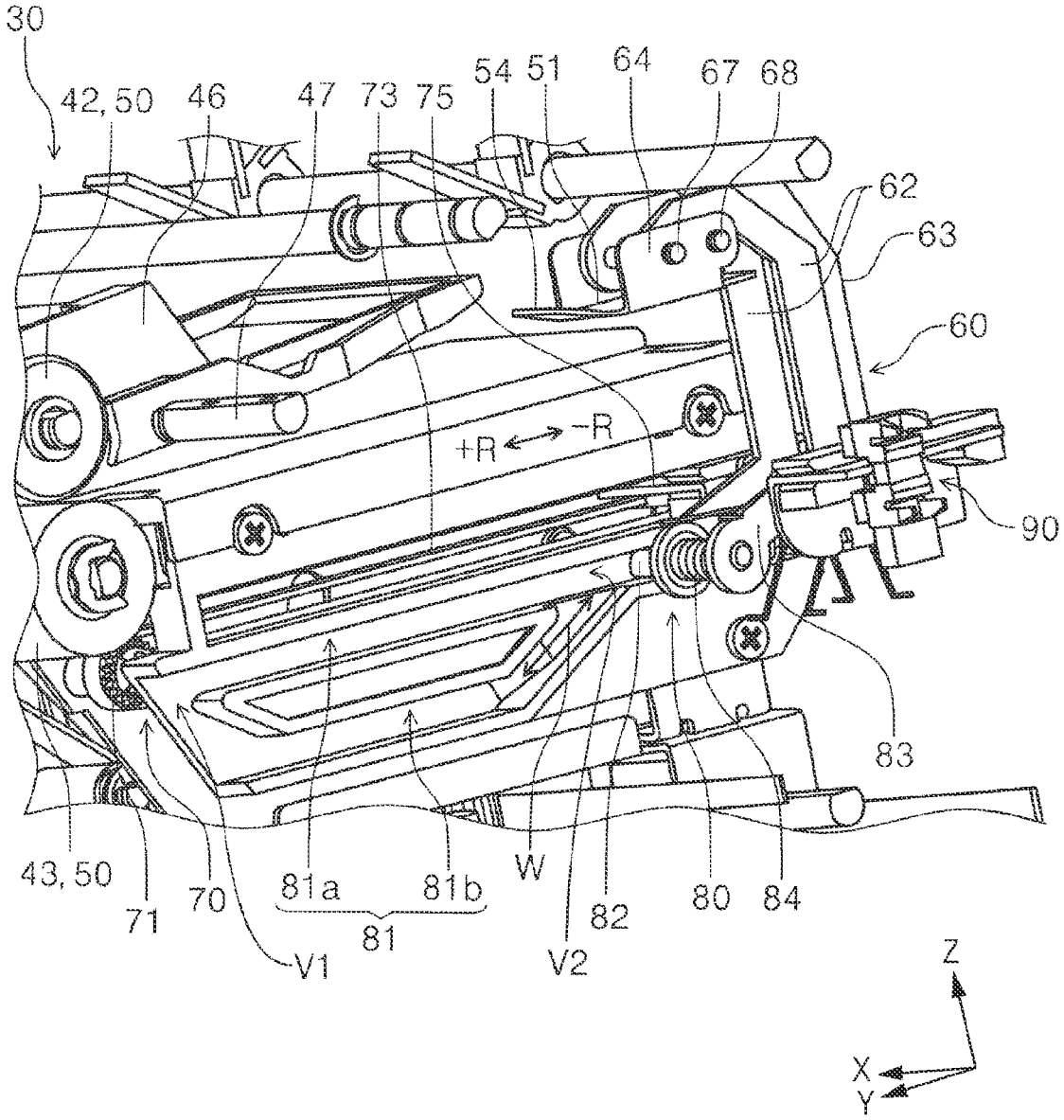
FIG. 9 is an enlarged perspective view of the vicinity of a first curl suppressing member.

In the second groove portion 81*b*, the region indicated by reference sign W in FIG. 9 is formed shallower than the other regions. An area other than the area W in the second groove portion 81*b* is formed to the same depth as the first groove portion 81*a*. That is, among a connecting portion V1 and a connecting portion V2 of the first groove portion 81*a* and the second groove portion 81*b* illustrated in FIG. 9, there is no step in the connecting portion V1 on the discharge direction +R side; however, there is a step in the connecting portion V2 on the return direction −R side, and the first groove portion 81*a* is deeper.

The guide pin 82 is pressed in the +X direction by a coil spring 84 (see also FIG. 7). By the pressing force of the coil spring 84, the guide pin 82 that moves in the second groove portion 81*b* in the return direction −R can be reliably returned from the second groove portion 81*b*, which is shallow, to the first groove portion 81*a*, which is deep, in the connecting portion V2, in addition, when the guide pin 82 moves in the first groove portion 81*a* in the discharge direction +R, it is possible to prevent the connecting portion V2 from being accidentally inserted into the second groove portion 81*b*.

By using the link mechanism 60 and the cam mechanism 80 as described above, a configuration can be realized in which a predetermined attitude is maintained when the first curl suppressing members 51 move in the discharge direction.

In the present embodiment, the processing unit 4 can be regarded as a "medium processing apparatus" that includes the medium discharging apparatus 30 and the processing portion 36 that performs predetermined processing on a medium placed on the first tray 35. In addition, the recording system 1 can be regarded as a "medium processing apparatus" that includes the medium discharging apparatus 30 and the processing portion 36 that performs predetermined processing on a medium placed on the first tray 35. In addition, an apparatus from which a recording function is omitted from the recording system 1 can be regarded as the "medium discharging apparatus". Alternatively, even if the recording function is provided, the recording system 1 itself can be regarded as a medium discharging apparatus from the viewpoint of medium transport.

In addition, it goes without saying that the present disclosure is not limited to the above embodiment, and various modifications are possible within the scope of the disclosure described in the claims, and they are also included in the scope of the present disclosure.

What is claimed is:

1. A medium discharging apparatus comprising:

a first tray in which a medium is received and placed;

a second tray in which the medium discharged from the first tray is received;

a discharging mechanism that discharges the medium from the first tray toward the second tray;

a curl suppressing member that suppresses curling of the medium discharged from the first tray to the second tray by the discharging mechanism;

a link mechanism in which the curl suppressing member is provided;

a movement mechanism configured to move the link mechanism and the curl suppressing member in both the discharge direction and a return direction opposite to the discharge direction; and a cam mechanism that guides movement of the link mechanism.

2. The medium discharging apparatus according to claim 1, wherein the cam mechanism includes a guide groove that guides the movement of the link mechanism, and a guide pin guided along the guide groove.

3. The medium discharging apparatus according to claim 2, wherein the guide groove includes a first groove portion through which the guide pin passes when the link mechanism moves in the discharge direction, and a second groove portion continuously provided below the first groove portion and through which the guide pin passes when the link mechanism moves in the return direction.

4. The medium discharging apparatus according to claim 3, wherein the first groove portion is deeper than the second groove portion to define a step at a connecting portion between the first groove portion and the second groove portion on a return direction side.

5. The medium discharging apparatus according to claim 4, wherein the guide pin is pressed in a depth direction of the step by a first pressing member.

6. The medium discharging apparatus according to claim 2, wherein the movement mechanism includes an endless belt, and the link mechanism moves in the discharge direction when the endless belt rotates in a first direction, and the link mechanism moves in the return direction when the endless belt rotates in a second direction.

7. The medium discharging apparatus according to claim 3, wherein:

the link mechanism includes a first arm portion provided along the discharge direction, a second arm portion and a third arm portion that are configured to pivot with respect to the first arm portion while maintaining parallel to each other, and a fourth arm portion disposed parallel to the first arm portion and configured to pivot with respect to the second arm portion and the third arm portion, the movement mechanism is configured to move the first arm portion in both the discharge direction and the return direction, and the curl suppressing member is provided on the fourth arm portion.

8. The medium discharging apparatus according to claim 7, wherein the cam mechanism rotates the second arm portion in accordance with the movement of the first arm portion in the discharge direction or the return direction.

9. The medium discharging apparatus according to claim 8, wherein when the guide pin moves from the first groove portion to the second groove portion, the cam mechanism and the second arm portion rotate by a pressing force of a second pressing member.

10. The medium discharging apparatus according to claim 1, wherein the curl suppressing member is located above a rear end region of the medium in the discharge direction and that moves so as to follow movement of the rear end region.

11. A medium processing apparatus comprising:

the medium discharging apparatus according to claim 1; and a processing portion that performs predetermined processing on the medium placed on the first tray.

12. A recording system comprising:

a recording unit including a recorder that performs recording on the medium; and a processing unit that includes the medium discharging apparatus according to claim 1, the medium discharging apparatus being configured to discharge the medium after the recording in the recording unit, and that includes a processing portion that performs predetermined processing on the medium placed on the first tray.

* * * * *